US010924851B2

(12) United States Patent
Liu et al.

(10) Patent No.: US 10,924,851 B2
(45) Date of Patent: Feb. 16, 2021

(54) AUDIO INTERACTION DEVICE, DATA PROCESSING METHOD AND COMPUTER STORAGE MEDIUM

(71) Applicant: Beijing Xiaoniao Tingting Technology Co., LTD, Beijing (CN)

(72) Inventors: Song Liu, Beijing (CN); Shasha Lou, Beijing (CN); Bo Li, Beijing (CN)

(73) Assignee: Beijing Xiaoniao Tingting Technology Co., LTD, Beijing (CN)

( * ) Notice: Subject to any disclaimer, the term of this patent is extended or adjusted under 35 U.S.C. 154(b) by 0 days.

(21) Appl. No.: 16/438,971

(22) Filed: Jun. 12, 2019

(65) Prior Publication Data

US 2019/0387312 A1 Dec. 19, 2019

(30) Foreign Application Priority Data

Jun. 13, 2018 (CN) ..... 2018 1 0608620

(51) Int. Cl.

| | |
|---|---|
| ***H04R 1/02*** | (2006.01) |
| ***H04R 3/00*** | (2006.01) |
| ***H04R 1/04*** | (2006.01) |
| ***H04R 1/40*** | (2006.01) |
| ***H04R 29/00*** | (2006.01) |

(52) U.S. Cl.

CPC ..... *H04R 3/005* (2013.01); *H04R 1/04* (2013.01); *H04R 1/406* (2013.01); *H04R 29/005* (2013.01)

(58) Field of Classification Search

CPC ..... H04R 1/406; H04R 3/005; H04R 1/04; H04R 1/342; H04R 29/004; H04R 29/005

USPC ..... 381/334, 335, 91

See application file for complete search history.

(56) References Cited

U.S. PATENT DOCUMENTS

| | | | | |
|---|---|---|---|---|
| 6,469,732 | B1 * | 10/2002 | Chang | G10L 25/78 348/14.01 |
| 2008/0285772 | A1 | 11/2008 | Haulick | |
| 2010/0303272 | A1 * | 12/2010 | Yoshino | H04R 1/08 381/357 |
| 2012/0294118 | A1 | 11/2012 | Haulick | |
| 2014/0185814 | A1 | 7/2014 | Cutler | |

FOREIGN PATENT DOCUMENTS

| | | | |
|---|---|---|---|
| EP | 1983799 | A1 | 10/2008 |

OTHER PUBLICATIONS

Supplementary European Search Report in the European application No. 19179698.6, dated Sep. 20, 2019.

* cited by examiner

*Primary Examiner* — George C Monikang
(74) *Attorney, Agent, or Firm* — Syncoda LLC; Feng Ma

(57) ABSTRACT

An audio interaction device includes a shell, multiple microphones located in multiple accommodation portions of the shell, at least one processor and a memory device configured to store a computer program capable of running on the processor. The processor is configured to run the computer program to execute the following operations. Audio signals obtained by the multiple microphones are identified, and the audio signals are processed. The multiple microphones are boundary microphones and arranged at positions close to a first surface of the shell of the audio interaction device, and the first surface is attached or close to a placement surface on which the audio interaction device is placed.

20 Claims, 8 Drawing Sheets

AUDIO INTERACTION DEVICE, DATA PROCESSING METHOD AND COMPUTER STORAGE MEDIUM

CROSS-REFERENCE TO RELATED APPLICATION

The present application claims priority to Chinese Patent Application No. 201810608620.1 filed on Jun. 13, 2018, the disclosure of which is hereby incorporated by reference in its entirety.

BACKGROUND

With audio output devices becoming smarter, an audio output device may not only have an audio output function but also have an audio input function and thus becomes a voice interaction device for convenient voice interaction with a user. A microphone array rather than a single microphone is used in more and more voice interaction devices to improve voice input quality such as intelligibility and a signal to noise ratio.

SUMMARY

The disclosure relates to the field of loudspeaker boxes, and more particularly to an audio interaction device, a data processing method and a computer storage medium.

In order to solve existing technical problems, embodiments of the disclosure provide an audio interaction device, a data processing method and a computer storage medium.

To this end, the technical solutions of the embodiments of the disclosure are implemented as follows.

The embodiments of the disclosure provide an audio interaction device, which includes a shell, multiple microphones located in multiple accommodation portions of the shell, at least one processor and a memory configured to store a computer program capable of running on the processor. The processor is configured to run the computer program to execute the following operation. Audio signals obtained by the multiple microphones are identified, and the audio signals are processed.

Herein, distances between the multiple microphones and a first surface of the shell of the audio interaction device is less than a first threshold value. The first surface is parallel to a plane where the multiple microphones are located, and located between the plane where the multiple microphones are located and a placement surface.

In the solution, the multiple microphones are boundary microphones, and arranged at positions close to the first surface of the shell of the audio interaction device. The first surface may be attached or close to the placement surface on which the audio interaction device is placed.

In the solution, the shell may be provided with multiple first acoustic transmission holes, where each of the multiple first acoustic transmission holes corresponds to each microphone of the multiple microphones, and the multiple first acoustic transmission holes may be located at a junction of the first surface and a lateral surface of the audio interaction device.

In the solution, the shell provided with the multiple first acoustic transmission holes may be formed with multiple accommodation portions, each accommodation portion having at least one reflective surface, and the microphones may be located in the multiple accommodation portions.

In the solution, each microphone of the multiple microphones may correspond to each portion of the multiple accommodation portions, and the multiple accommodation portions may have the same structure.

In the solution, the multiple first acoustic transmission holes may form centrosymmetric openings on the shell.

In the solution, the number of the multiple microphones may be associated with at least one attribute parameter of an audio signal to be received.

In the solution, any two adjacent microphones of the multiple microphones have equal included angles formed by the any two adjacent microphones and a central axis of the audio interaction device.

In the solution, the device may further include at least one loudspeaker. The at least one loudspeaker may be arranged at a position close to a second surface of the shell of the audio interaction device, where the second surface may be away from the first surface.

In the solution, the shell may be provided with at least one second acoustic transmission hole, each hole corresponding to each loudspeaker of the at least one loudspeaker. The at least one acoustic transmission hole may be located on the second surface, away from the first surface, of the shell.

In the solution, an application including a processing algorithm of a microphone array signal may be stored in the memory.

The processor may be configured to run the application including the processing algorithm of the microphone array signal to execute the following operations. A first sound source position is determined using at least one microphone pair formed by any two microphones of the multiple microphones by delay estimation and/or amplitude estimation; and weighting processing is performed on multiple determined first sound source positions to obtain a sound source position.

The operation that the weighting processing is performed on the multiple determined first sound source positions to obtain the sound source position may include the following actions. A weight value of the first sound source position corresponding to the microphone pair is determined based on at least one of the following information, and weighting processing is performed based on the weight value and the corresponding first sound source position to obtain the sound source position.

The information may include: an amplitude relationship of the audio signals received by the two microphones in the microphone pair, energy of the audio signal received by any microphone in the microphone pair, a distance between the two microphones in the microphone pair, or an attribute parameter of the audio signal received by any microphone in the microphone pair, where the attribute parameter includes at least one of: frequency, period or wavelength.

The embodiments of the disclosure also provide a data processing method, which is applied in the audio interaction device of the embodiments of the disclosure and includes the following operations.

Audio signals are obtained through multiple microphones;

a first sound source position is determined using at least one microphone pair formed by any two microphones of the multiple microphones by delay estimation and/or amplitude estimation; and weighting processing is performed on multiple determined first sound source positions to obtain a sound source position.

In the solution, the operation that the weighting processing is performed on the multiple determined first sound source positions to obtain the sound source position may include the following actions.

A weight value of the first sound source position corresponding to the microphone pair is determined based on at least one of the following information, and weighting processing is performed based on the weight value and the corresponding first sound source position to obtain the sound source position.

The information may include: an amplitude relationship of the audio signals received by the two microphones in the microphone pair, energy of the audio signal received by any microphone in the microphone pair, a distance between the two microphones in the microphone pair, or an attribute parameter of the audio signal received by any microphone in the microphone pair, where the attribute parameter includes at least one of: frequency, period or wavelength.

The embodiments of the disclosure also provide a computer-readable storage medium, in which a computer program may be stored, the computer program being executed by a processor to implement the operations of the data processing method in the embodiments of the disclosure.

According to the audio interaction device, data processing method and computer storage medium in the embodiments of the disclosure, the device includes the shell, the multiple microphones located in the multiple accommodation portions of the shell, the at least one processor and the memory configured to store the computer program capable of running on the processor. The processor is configured to run the computer program to execute the following operations. The audio signals obtained by the multiple microphones are identified, and the audio signals are processed. Herein, the distances between the multiple microphones and the first surface of the shell of the audio interaction device are less than the first threshold value. The first surface is parallel to the plane where the multiple microphones are located, and located between the plane where the multiple microphones are located and the placement surface. By using the technical solutions of the embodiments of the disclosure, the microphones are arranged at a bottom, close to the placement surface, of the audio interaction device, and a hidden boundary microphone array is used, so that the degree of freedom and the aesthetic measure for design of the interaction device are improved, the overall attractive appearance of the audio interaction device is improved, and noises produced by accidentally touching the microphones during operation are also avoided. On the other aspect, under the condition of not increasing the cost, a signal to noise ratio and directivity of the microphone are improved, and higher array performance is achieved.

DETAILED DESCRIPTION

The disclosure will further be described below in combination with the drawings and specific embodiments in detail.

The inventors of the present application have recognized that, a microphone array may bring difficulties to appearance design. Arrangement of microphones may conflict with arrangement of other devices; much compromise is required and the appearance may also be affected.

Taking a common intelligent loudspeaker box as an example, in a common product on the market, a microphone array is usually placed nearby an upper surface of the product, and a conspicuous acoustic transmission hole or acoustic transmission mesh is arranged on a housing and a loudspeaker of the product is placed at a lower half portion of the product. Both of the appearance design and the sound quality are restricted.

In a conventional design, to make responses of microphones consistent, it is necessary to avoid the microphones from influence of reflection and their own acoustic structures, and no shields between the microphones may usually be required. A microphone module has a big acoustic transmission hole. In such case, a microphone array is usually arranged at a top or most protruding outer side of a device, an outer surface is substantially flat, and there are big acoustic transmission holes in the microphone. To avoid overload distortion of signals of microphones due to excessively loud sound in an interaction device such as an intelligent loudspeaker box, a loudspeaker of the intelligent loudspeaker box is required to be away from a microphone array and thus located at a lower portion of the loudspeaker box. Therefore, the loudspeaker is close to a (for example, a table top or the ground) where the intelligent loudspeaker box is placed. The loudspeaker placed at the lower portion limits a sound playing effect of the intelligent loudspeaker box, so that formation of an acoustic transmission hole on the top is required, which, however, affects the appearance. In addition, the top or outer side of the device is usually a portion that a user often sees and touches, and the big acoustic transmission hole also makes the microphone easy to be accidentally touched during operation to make some noises.

Figure 1:
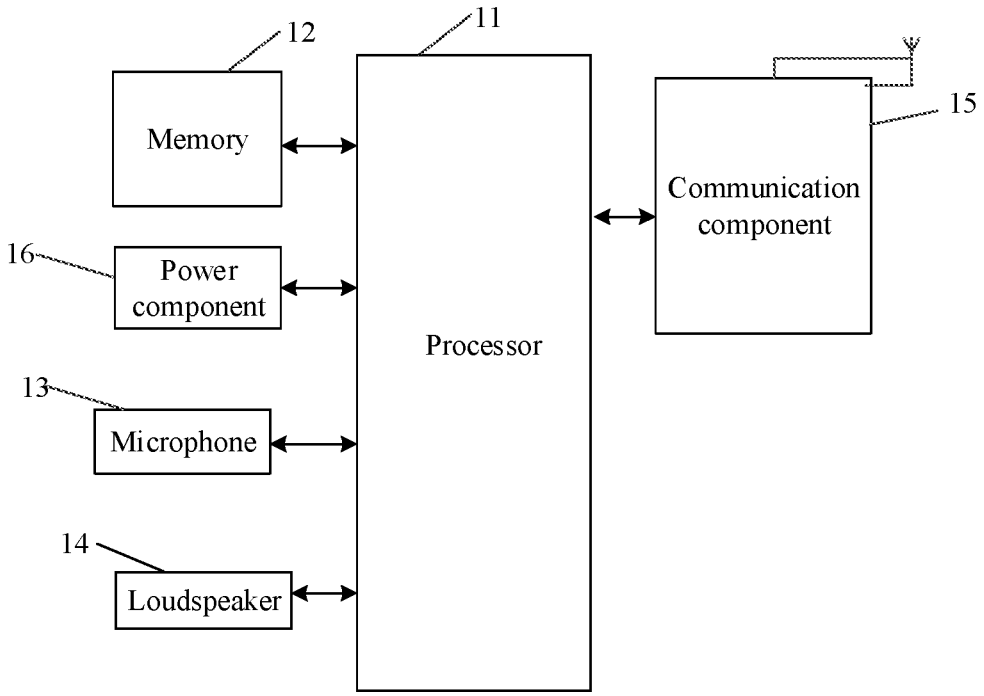
FIG. 1 is a schematic diagram of a structure of an audio interaction device according to an embodiment of the disclosure.
Figure 2:
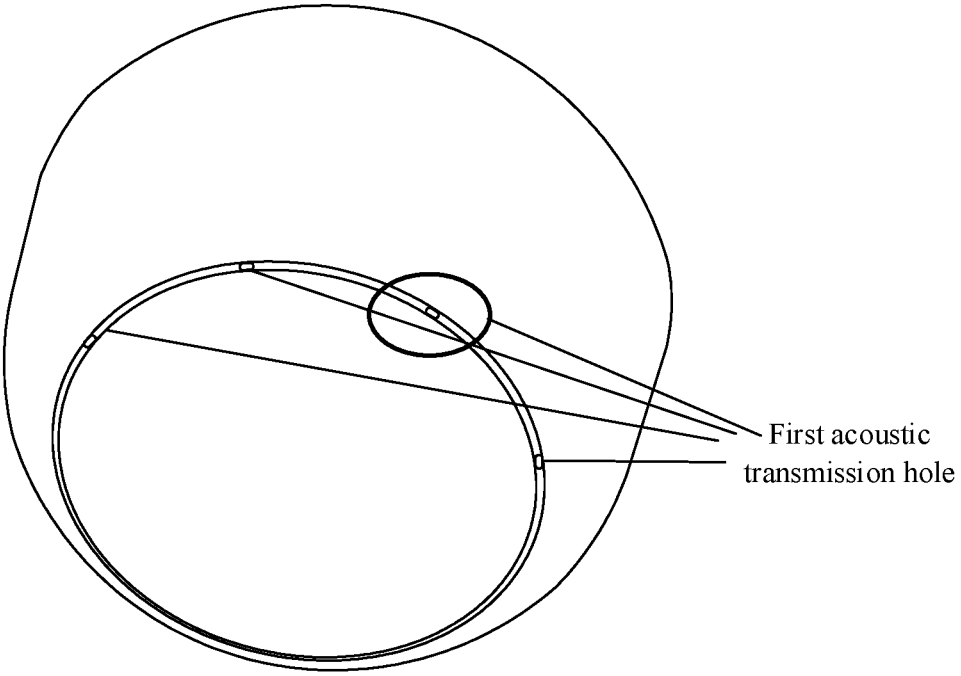
FIG. 2 is a bottom view of an audio interaction device according to an embodiment of the disclosure.

An embodiment of the disclosure provides an audio interaction device. FIG. 1 is a schematic diagram of a structure of an audio interaction device according to an embodiment of the disclosure. FIG. 2 is a bottom view of an audio interaction device according to an embodiment of the disclosure. Referring to FIG. 1 and FIG. 2, the device includes a shell, multiple microphones located in multiple accommodation portions of the shell, at least one processor and a memory configured to store a computer program capable of running on the processor. The processor is configured to run the computer program to execute the following operations. Audio signals obtained by the multiple microphones are identified, and the audio signals are processed.

Herein, distances between the multiple microphones and a first surface of the shell of the audio interaction device are less than a first threshold value. The first surface may be parallel to a plane where the multiple microphones are located, and located between the plane where the multiple microphones are located and a placement surface.

In the embodiment, the audio interaction device has an audio input function. During a practical application, the audio interaction device may be a terminal device such as an intelligent loudspeaker box, a loudspeaker, a phone, a mobile phone and a boundary microphone. Herein, the audio interaction device has at least one plane, and the at least one plane includes the first surface. As an implementation mode, when the audio interaction device is placed on the placement surface, the first surface is attached or close to the placement surface. The placement surface is a plane on which the audio interaction device is placed. The placement surface may be a plane such as the ground and a table top. The placement surface may also be a vertical wall surface or a wall surface of a roof. No matter how the audio interaction device is placed on the placement surface, the first surface is a plane attached to the placement surface or a plane close to the placement surface (that is, the first surface in the audio interaction device is closest to the placement surface).

As another implementation mode, when the microphone is of a boundary microphone type, the first surface may also be a boundary of a boundary microphone, for example, a boundary formed by a bracket of the boundary microphone.

In the embodiment, the plane where the multiple microphones are located is parallel to the first surface, or considering that a certain error may exist in an arrangement process of the microphones, the plane where the multiple microphones are located is approximately parallel to the first surface. Moreover, the first surface is located between the plane where the multiple microphones are located and the placement surface. Under the condition that the distances between the multiple microphones and the first surface are less than the first threshold value, it can be understood that the multiple microphones are arranged at a lower portion of the audio interaction device.

Taking that the first surface is a surface attached or close to the placement surface as an example, the audio interaction device is attached or close to the placement surface through the first surface, and since the distances between the multiple microphones and the first surface are less than the first threshold value, the multiple microphones are attached to the placement surface. Herein, the placement surface may also be called a first boundary. A path through which a sound source reaches the microphone may include the following paths. A first path through which the audio signal transmitted by the sound source directly reaches the microphone, and this audio signal may be called a direct audio signal; and a second path through which the audio signal reaches the first boundary and reaches the microphone after being reflected by the first boundary, this audio signal being called a reflected audio signal. When the first boundary is close to the microphone, since a distance between the first boundary and the microphone is short, the reflected audio signal and direct audio signal of the first boundary almost reach the microphone at the same time. Therefore, the audio signal received by the microphone is enhanced. That is, an acoustic reflection effect of the first boundary may improve a signal to noise ratio and sensitivity of the microphone within a wide frequency band.

It can be understood that, when a user speaks, a voice audio produced by the user reaches the microphone through multiple paths and is picked up by the microphone. These paths include a shortest path and a reflection path. When the distance between the boundary and the microphone is very short and far less than a sound wavelength of the voice audio, the shortest path and the reflection path have close lengths, and the voice audios reaching the microphone through the two paths are completely correlated and almost superimposed on the same phase, so that the amplitude is increased twice, energy is increased to four times, and sensitivity (10 log(4)) is enhanced by 6 dB.

The boundary may also have an enhancement effect on environmental noises. However, since the environmental noises are isotropic random noises, the sensitivity may not be improved by 6 dB like the voice audio, and may only be improved by 3 dB (10 log(2)). Such a boundary improves sensitivity to a voice by 6 dB and improves sensitivity to noises by 3 dB, and thus a total signal to noise ratio is increased by 3 dB (10 log(2)).

According to the similar principle, effects of multiple boundaries may further increase the signal to noise ratio. Two boundaries may increase the signal to noise ratio by 5 dB (10 log(3)).

Besides the placement surface, a second boundary or more boundaries may also be designed around the microphone by reasonable appearance design. As an implementation mode, the shell of the audio interaction device is formed with an accommodation portion having at least one reflective surface, and the microphones are located in the accommodation portion. Herein, the at least one reflective surface of the accommodation portion configured to accommodate the microphone may be called a second boundary. Similar to the first boundary, since a distance between the second boundary and the microphone is short, a reflected audio signal and direct audio signal on the second boundary can reach the microphone almost at the same time, so that the audio signal received by the microphone is enhanced. In another application scenario, the audio interaction device may also be placed in a manner that the first surface is close to a wall. Under the condition that a distance between the wall and the microphone is short, the wall surface may also be used as a boundary to achieve the effect of enhancing the audio signal received by the microphone.

Therefore, under the condition that the boundary has the same influence on the multiple microphones of the device (for example, the boundary is used as the placement surface, structures of the microphones are same and the microphones form the same angle with the boundary), a lift amount of a sensitivity of the microphone is positively correlated with the number of the boundaries. For example, on the premise that the distance between the boundary and the microphone is far less than a wavelength of an audio signal to be acquired, one boundary can increase a signal to noise ratio of the audio signal relative to an environmental background noise by 3 dB, two boundaries can increase the signal to noise ratio of the audio signal relative to an environmental background noise by 5 dB and the like.

In the embodiment, the audio interaction device includes the shell, and the shell may be a centrosymmetric shell and may also be an asymmetric shell. When the shell is a shell with a centrosymmetric relationship, the first surface of the shell may be in a shape with the centrosymmetric relationship such as a round and a regular polygon. A lateral surface of the audio interaction device may be perpendicular to the first surface, or an inner wall of the lateral surface of the audio interaction device may form an acute angle or an obtuse angle with the first surface. As illustrated in FIG. 2, the inner wall of the lateral surface of the audio interaction device forms an obtuse angle with the ground.

In the embodiment, the audio interaction device is provided with a microphone array formed by the multiple microphones, and the multiple microphones are configured to acquire the audio signals. The multiple microphones are arranged at the bottom of the audio interaction device. It can be understood that the multiple microphones are close to the first surface of the audio interaction device, that is, the distances between the multiple microphones and the first surface of the shell of the audio interaction device are less than a first threshold value. Herein, the distances between the multiple microphones and the first surface of the shell of the audio interaction device may be zero, namely the multiple microphones are arranged at a junction of the first surface of the audio interaction device and the lateral surface of the audio interaction device, specifically as illustrated in FIG. 2. As an implementation mode, the shell is provided with multiple first acoustic transmission holes, where each of the multiple first acoustic transmission holes corresponds to each microphone of the multiple microphones. As an implementation mode, the multiple first acoustic transmission holes may be located on the lateral surface of the audio interaction device. As another implementation mode, the multiple first acoustic transmission holes are located at the junction of the first surface and the lateral surface of the audio interaction device. The microphones receive the audio signals through the corresponding first acoustic transmission holes.

Based on the abovementioned embodiment, in another embodiment, the audio interaction device may further have an audio output function, namely the device may further include at least one loudspeaker. A distance between the at least one loudspeaker and the plane where the multiple microphones are located is greater than a second threshold value. It can be understood that the at least one loudspeaker is away from the first surface of the shell. Then, the shell is further provided with at least one second acoustic transmission hole, each hole corresponding to each loudspeaker in the at least one loudspeaker. The at least one acoustic transmission hole is located on the second surface, away from the first surface, of the shell, namely the at least one second acoustic transmission hole may be located on the second surface of the shell, which can be understood as a top surface opposite to a bottom surface. The loudspeaker outputs the audio signal through the corresponding second acoustic transmission hole. Herein, the shell is provided with the at least one second acoustic transmission hole, each hole corresponding to the at least one loudspeaker, and the at least one acoustic transmission hole is located on the second surface, away from the first surface, of the shell. For example, under the condition that the first surface is the bottom surface, the second surface may be the top surface. Or, the second surface may also be part of a region in the lateral surface away from the first surface.

During a practical application, the distance between the microphone and the loudspeaker is far less than a distance between the microphone and the user, and an audio signal component transmitted by the loudspeaker in the audio signal received by the microphone is far more than an audio signal component of the user, so that the audio signal of the user is covered. Although the audio signal component of the most loudspeakers may be eliminated by a conventional echo cancellation algorithm and the like, performance of the echo cancellation algorithm has physical limits. The sound component of the loudspeaker may be reduced by about 30 dB under the condition that the loudspeaker is high in quality and an upper limit of a measurable sound pressure level of the microphone is higher than a sound pressure level of the signal of the loudspeaker at the microphone, and may only be reduced by 20 dB to 25 dB under many conditions. For recovering the audio signal of the user better, a proportion of the audio signal component of the loudspeaker in the signal received by the microphone should be as small as possible, that is, the audio signal of the loudspeaker should be as weak as possible when reaching the microphone. On such a basis, the distance between the plane where the multiple microphones are located and the loudspeaker is greater than the second threshold value, that is, the microphones should be as far as possible away from the loudspeaker. In an embodiment, the microphones and the loudspeaker are arranged at two ends of a long axis of the device. A measured value of the audio signal transmitted by the loudspeaker at the microphone is lower than the upper limit of the measurable sound pressure level of the microphone.

During the practical application, as an implementation mode, the distance between the microphone and the loudspeaker is maximum within a size range of the audio interaction device, namely the microphone is arranged on the first surface of the audio interaction device and the loudspeaker is arranged on the second surface of the audio interaction device, that is, the distance between the at least one loudspeaker and the plane where the multiple microphones are located is equal to a height of the audio interaction device.

As another implementation mode, a layout of the loudspeaker and the microphones may also be adapted to an internal layout design of the audio interaction device, and the second threshold value is related to a maximum volume of the loudspeaker, the upper limits of the measurable sound pressure levels of the multiple microphones and a size of the audio interaction device. For example, when being played by the loudspeaker at the maximum volume, the audio signal received by the microphone is lower than the sound pressure level measurement upper limit of the microphone. For example, when being played by the loudspeaker at the maximum volume, the audio signal has a sound pressure level of 110 dB at a distance of 10 cm, and has a sound pressure level of 104 dB at a distance of 20 cm. When the sound pressure level measurement upper limit of the microphone of a certain type used in the device is 104 dB, the microphone of this type may be used normally only when the distance between the microphone and the loudspeaker is not shorter than 20 cm. When the distance between the microphone and the loudspeaker is 10 cm due to a limit of a product size, the microphone of another type of which the measurement upper limit is not lower than 110 dB is required to be used.

On such a basis, in the embodiment of the disclosure, when the distance between the microphone and the loudspeaker is maximum within a size range of the audio interaction device and the audio signal received by the microphone and transmitted by the loudspeaker at the maximum volume is lower than the sound pressure level measurement upper limit of the microphone (namely an upper limit of the sound pressure level measurement of the microphone can satisfy the maximum volume of the loudspeaker), a first distance may be determined based on the maximum volume of the loudspeaker and the sound pressure level measurement upper limit of the microphone. The first distance is an allowed minimum distance between the loudspeaker and the microphone under the condition that the loudspeaker is used normally. The second threshold value is greater than or equal to the first distance. Correspondingly, the distances between the multiple microphones and the first surface of the shell of the audio interaction device are less than the first threshold value, and the first threshold value may be determined based on a size of the audio interaction device (specifically a height of the device) and the second threshold value.

It can be understood that, on the basis that the size of the audio interaction device (specifically the height of the device) is greater than the second threshold value, the layout of the multiple microphones and the loudspeaker may be adapted to the internal layout design on the basis that the distances between the multiple microphones and the loudspeaker are greater than the second threshold value. For example, the multiple microphones may be at positions close to the first surface of the audio interaction device and may even be located on the first surface. Correspondingly, the first acoustic transmission holes corresponding to the multiple microphones may be located on the first surface and a lateral surface close to the first surface, and may even be located at a junction of the first surface and the lateral surface, as illustrated in FIG. 2. In a scenario that the first acoustic transmission holes are located on the lateral surface close to the first surface, the inner wall of the lateral surface of the audio interaction device forms the obtuse angle illustrated in FIG. 2 with the first surface, and no matter how the audio interaction device is placed, the first acoustic transmission holes are back on to the line of sight of the user, and compared with arrangement of the first acoustic transmission holes at the junction of the first surface and lateral surface of the shell, both of the two solutions may avoid influence on the attractive appearance of the device. It can be understood that, as a first implementation mode, the multiple first acoustic transmission holes may be formed at the junction of the first surface and the lateral surface of the audio interaction device. As a second implementation mode, the multiple first acoustic transmission holes may be formed in the lateral surface of the shell of the audio interaction device under the condition that the inner wall of the lateral surface of the shell of the audio interaction device forms the obtuse angle greater than a threshold value with the first surface. In another implementation mode, the first surface of the audio interaction device may be provided with at least three support members, and the audio interaction device is placed on the placement surface through the at least three support members. In this application scenario, the first acoustic transmission holes may also be formed on the first surface. In this implementation solution, influence on the attractive appearance of the device is also avoided.

In the embodiment, the multiple first acoustic transmission holes form centrosymmetric openings on the shell, and the openings formed by the multiple first acoustic transmission holes on the shell are the same. Specifically, the opening formed by the multiple first acoustic transmission holes on the shell may be, for example, at least one of centrosymmetric opening such as a slit, a round hole or a regularly polygonal hole.

Figure 3:
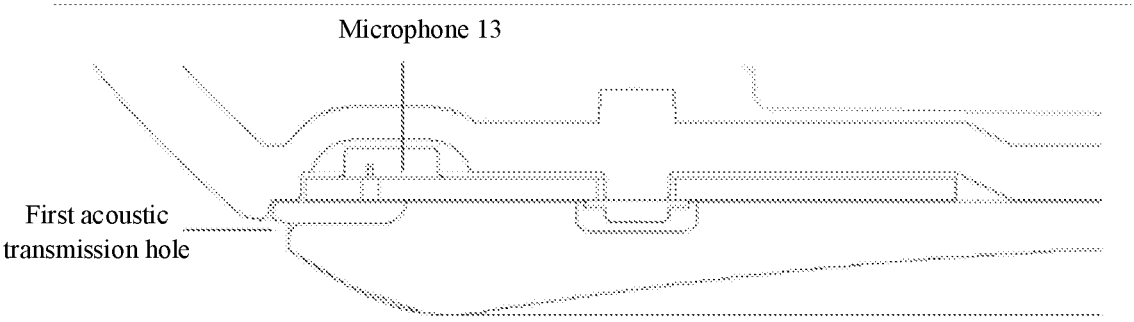
FIG. 3 is a partial sectional view of positions of a microphone of an audio interaction device according to an embodiment of the disclosure.

During the practical application, as an implementation mode, the layout positions of the multiple microphones are close to the first surface of the shell of the audio interaction device or close to the lateral surface of the shell. In another embodiment, the shell provided with the multiple first acoustic transmission holes is formed with multiple accommodation portions, each accommodation portion having at least one reflective surface, and the microphones are located in the accommodation portions. FIG. 3 is a partial sectional view of a position of a microphone of an audio interaction device according to an embodiment of the disclosure. As illustrated in FIG. 3, it can be understood that, for example, taking that the layout positions of the microphones are close to the first surface of the shell of the audio interaction device as an example, the microphones have certain distances from the first surface or the junction of the first surface and the lateral surface. The shell of the audio interaction device is formed with a groove or a chamfer to form the accommodation portion having the at least one reflective surface, and the microphones are located in the accommodation portion. Since the accommodation portion has the at least one reflective surface, the reflective surface may be called the foregoing second boundary, so that the signal to noise ratios of the microphones can be increased. For example, the signal to noise ratios of the microphones at intermediate and high frequencies can be increased by about 3 dB to 5 dB.

In the embodiment, each microphone of the multiple microphones corresponds to each portion of the multiple accommodation portions, and the multiple accommodation portions have the same structure, namely each microphone corresponds to the same accommodation portion structure.

In the embodiment, as an implementation mode, any two adjacent microphones of the multiple microphones have equal included angles formed by the any two adjacent microphones, that is, the microphone array formed by the multiple microphones is uniformly arranged. Accordingly, omnidirectional (namely 360 degrees) reception is facilitated, and it is avoided that the multiple microphones are laid out on a certain side in a centralized manner. When a sound source is back on to the side, the audio signals transmitted by the sound source are required to be diffracted to the audio interaction device to reach the microphones because of shielding of the audio interaction device. In such a diffraction transmission manner, certain loss may be brought to high-frequency signals in the audio signals and a direct audio signal is lack. It is unfavorable for positioning processing over the sound source and enhancement processing over the audio signals in a specified direction. It can be understood that the multiple microphones are uniformly distributed on an edge of a cross section of the audio interaction device. Taking that the number of the multiple microphones is six as an example, they are arranged at the bottom of the audio interaction device and arranged in equal space, then a connecting line between a circle center of a plane where the six microphones are located and each microphone makes an included angle formed between any two adjacent microphones and the central axis of the device is 60 degrees.

As another implementation mode, the microphone array formed by the multiple microphones may also not be uniformly arranged, namely the irregularly arranged microphone array is adapted to a shell shape of the audio interaction device and/or an internal layout structure of the device. For example, when there are more studs or wires in the device, the microphone array cannot be uniformly laid out.

In the embodiment, the types of all the microphones and directivity of microphone array elements (the microphone array elements refer to the microphones and structures around the microphones) are known. This is because sound source positioning and signal enhancement processing in the specified direction are needed to be performed on the audio signals received by the microphones, and this requires that a receiving effect of each microphone is known. An attribute and parameter, for example, sensitivity and a frequency response index, of each microphone are known, and thus a reflection augmentation effect achieved by the accommodation portion for each microphone is known, and in combination with the structure of the accommodation portion, each microphone has known directivity and sensitivity.

In the embodiment, the number of the multiple microphones is associated with at least one attribute parameter of an audio signal to be received and a product feature of the audio interaction device. During design, a proper range of a distance between any two microphones of the multiple microphones may be determined based on the at least one attribute parameter of the audio signal to be received, and the number of the multiple microphones is further determined. In an example, under the restriction of cost of the product, a small number of microphones are used for the microphone array, and a small number of microphones correspond to a small number of analog-to-digital conversion chips, so that an operation load is low. In another example, a large number of microphones may be used, and increase of the number of the microphones improves directivity of the microphone array and also improves a processing effect. However, after the number of the microphones is increased to a certain number, a lift amount of the effect will not be so significant. There are two main reasons. One reason is that, for audio processing, main energy of an audio is distributed within [0, 4,000] Hz while a common audio transmission frequency band does not exceed [0, 8,000] Hz. When the microphones are arranged as densely as that a minimum distance between the microphones is shorter than 2 cm (¼ wavelength of a 4 kHz sound wave and ½ wavelength of an 8 kHz sound wave), when increasing the distribution density and number of the microphones, a lift amount of the directivity of the array will not be so significant (this is a common ½ wavelength spacing criterion in the array). The other reason is that the directivity of the microphone array is not required to be processed too sharply because a vocalization part of a speaker is not a single point but spatially occupies a certain angle range, the array should respond flatly within this angle range and excessively sharp directivity may result in loss of a part of audio instead.

On such a basis, in the embodiment of the disclosure, the proper range of the distance between any two microphones of the multiple microphones is determined based on the at least one attribute parameter of the audio signal to be received. The number of the multiple microphones is determined based on the distance between any two microphones and a feature of the audio interaction device (the feature may specifically be the restriction of the cost of the device and a size of the device). Herein, the distance between any two microphones satisfies a ½ wavelength of the audio signal to be received, and moreover, the distance between any two microphones is greater than or equal to 2 cm.

In the embodiment, an application including a signal processing algorithm of the microphone array is stored in the memory. The processor executes the application including the processing algorithm of the microphone array signal to implement sound source positioning and signal enhancement of the sound source based on the audio signals received by the multiple microphones. Herein, processing of sound source positioning includes processing of sound source orientation and determination processing of a distance with the sound source, namely sound source positioning is related to sound source orientation and the distance with the sound source.

Under a normal condition, a sound source direction is usually determined according to a delay relationship or amplitude relationship of the audio signals reaching each microphone of the microphone array, a sound source orientation result is obtained, and then the signal of the sound source is enhanced according to the sound source orientation result. Herein, a manner of determining the sound source position based on the delay relationship may be called a delay estimation manner, and a manner of determining the sound source position based on the amplitude relationship may be called an amplitude estimation manner. Herein, on the premise that a wavelength is less than twice of the distance between two microphones (i.e., the distance between two adjacent microphones), the delay relationship may be calculated according to a phase relationship of the audio signals.

On the other aspect, when the audio signal is radiated to a single microphone from the sound source position, the audio signal received by the microphone may have amplitude attenuation and a transmission delay. An audio received by each microphone in the microphone array may have a corresponding transmission delay and amplitude attenuation, and the sound source position may also be reversely educed from the amplitude relationship or the transmission delay relationship. Since each microphone in the microphone array has spatial directivity, the signal in a sound source direction may be enhanced, and other audio signals in a direction except the sound source direction may be attenuated.

During practical use, the distance between the sound source and each microphone is usually greater than an aperture of the microphone array and an amplitude difference is tiny, therefore, the delay relationship is usually used to determine the sound source direction. Herein, there is more than one path through which the sound source reaches the microphone, including the shortest path (usually the direct path) and many long reflection paths. The audio signal received by the microphone usually consists of a direct audio signal and a reflected audio signal. The transmission delay also includes a shortest delay and a reflection delay, where the shortest delay is usually a direct delay corresponding to the direct path, and the reflection delay is a delay corresponding to the reflection path. A relationship between the shortest delay and the sound source position is simple and unique, and a relationship between the reflection delay and the sound source position is complex and non-unique. When there are many reflective surfaces and a reflected sound is strong, there may be a delay calculation error and positioning accuracy may further be affected.

Figure 4A:
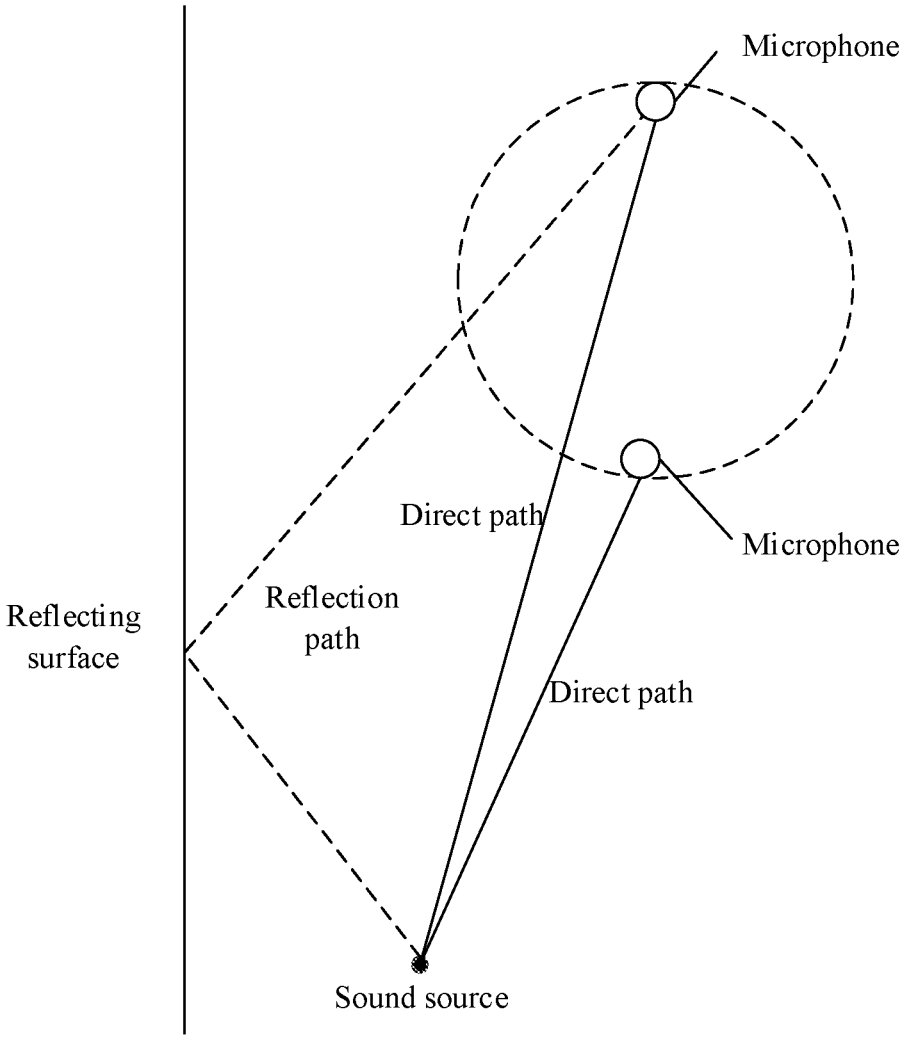
FIG. 4A is a schematic diagram of an audio transmission path of an existing audio interaction device.

For determining the sound source position by use of the shortest delay, the proportion of the direct audio signal may also be increased as much as possible in the layout of the microphone array in a common product design. Therefore, a common microphone array is arranged at the top of the audio interaction device, there are not shields between the microphones, the audio signal mainly include the direct audio signal, and the direct delay is calculated accurately, as illustrated in FIG. 4A.

Figure 4B:
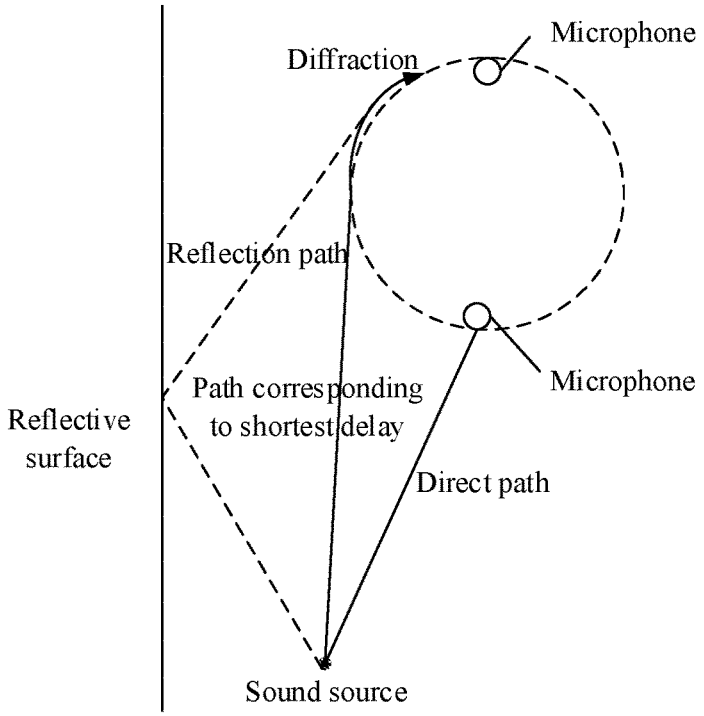
FIG. 4B is a schematic diagram of an audio transmission path of an audio interaction device according to an embodiment of the disclosure.

However, in the embodiment of the disclosure, the microphone array is laid out at a position close to the first surface, the direct audio signal is strong on the surface facing the sound source. On the surface back on to the sound source, there is no transmission path for the direct audio signal, the path corresponding to the shortest transmission delay is to diffract from the surface of the device, as illustrated in FIG. 4B, a high-frequency signal of the audio signal is greatly lost during diffraction, while the reflected audio signal is attenuated less. Therefore, total energy of the audio signal received by the microphone on the surface back on to the sound source, particularly a high-frequency portion, is reduced. Moreover, energy of the reflected audio signal is close to and even stronger than the audio signal corresponding to the path corresponding to the shortest delay. There may be a great error for delay calculation and positioning based on the delay. Moreover, diffraction attenuation is related to a length/radian of the diffraction path and a sound energy absorption characteristic of the outer surface of the product.

On such a basis, in the embodiment of the disclosure, the processor is configured to run the application including the microphone array signal processing algorithm to execute the following operations. A first sound source position is determined using at least one microphone pair formed by any two microphones of the multiple microphones by delay estimation and/or amplitude estimation; and weighting processing is performed on multiple determined first sound source positions to obtain a sound source position. Herein, the operation that the weighting processing is performed on the multiple determined first sound source positions to obtain the sound source position includes the following actions. A weight value of the first sound source position corresponding to the microphone pair is determined based on at least one of the following information, and weighting processing is performed based on the weight value and the corresponding first sound source position to obtain the sound source position. The information includes: an amplitude relationship of the audio signals received by the two microphones in the microphone pair, energy of the audio signal received by any microphone in the microphone pair, a distance between the two microphones in the microphone pair, or an attribute parameter of the audio signal received by any microphone in the microphone pair, where the attribute parameter includes at least one of: frequency, period or wavelength.

Herein, the operation that the first sound source position is determined by the delay estimation includes the following actions. A first audio signal received by a first microphone is obtained, and a second audio signal received by a second microphone is obtained; a receiving delay is determined based on the first audio signal and the second audio signal; a difference of distances between the sound source and each of the first microphone and the second microphone is determined based on the receiving delay; and the first sound source position is determined based on the difference of the distances and a distance between the first microphone and the second microphone.

Figure 5:
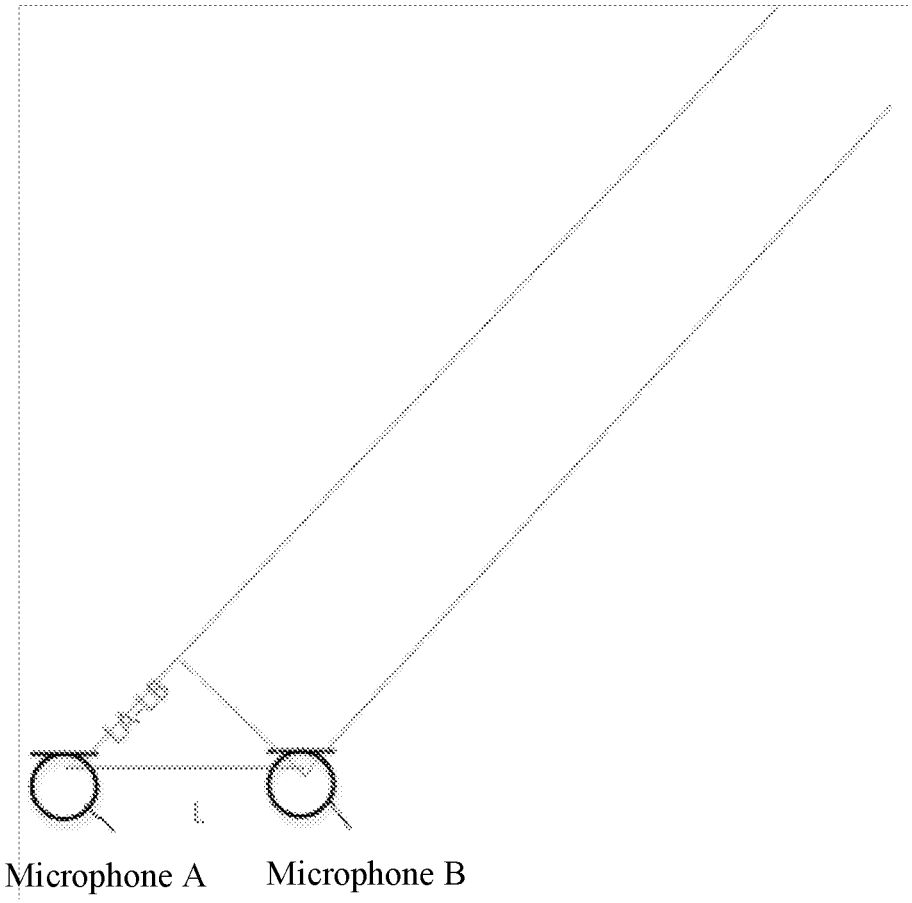
FIG. 5 is a schematic diagram of determining, by an audio interaction device, a sound source position by delay estimation according to an embodiment of the disclosure.

Specifically, referring to FIG. 5, a propagation velocity of an audio signal in the air is a constant value c, and when a sound s is transmitted from the sound source to a microphone A at a distance LA away from the sound source, an audio signal received by the microphone A may be represented as HA·s(t−LA/c); and when the sound s is transmitted from the sound source to a microphone B at a distance LB away from the sound source, a signal received by the microphone B may be represented as HB·s(t−LB/c). Herein, LA and LB represent transmitted energy attenuations respectively. When there is a background noise in the environment, the signals of the microphones may be represented as HA·s(t−LA/c)+nA(t) and HB·s(t−LB/c)+nB(t), where nA and nB are independently identically distributed random noise signals.

A relative receiving delay between the audio signals received by the microphone A and the microphone B is LA/c−LB/c, and when LA/c−LB/c may be calculated, under the condition that the propagation velocity c of the audio signal in the air is a constant value, a difference (LA−LB) of the distances between the sound source and each of the first microphone and the second microphone may be determined, and the distance is less than or equal to an distance L between the microphone A and the microphone B. (LA−LB)/L represents a cosine function value of an included angle between connecting lines of the sound source and each of the microphone A and the microphone B. An included angle between connecting lines of the sound source direction and each of the microphone A and the microphone B may further be determined based on the cosine function value, the distance L and the difference (LA−LB) of the distances. For an array formed by two microphones, it may be determined that the sound source is in a direction in a half plane of 0 to 180 degrees. When the number of the microphones is increased to three or more and the microphones are nonlinearly arranged, the direction of the sound source in a full plane may be accurately determined by use of a delay method for the microphone array. Multiple microphone pairs may be formed in the microphone array, and a final sound source direction may be obtained by a weighted combination of sound source directions calculated for the multiple microphone pairs.

Herein, the receiving delay is usually calculated by using a cross correlation method, a phase method and the like. Under the condition that the noise is not stronger than the audio signal and a period of the audio signal is more than twice of the relative receiving delay between any two microphones, the receiving delay may be calculated accurately by use of a conventional cross correlation method, cross power spectrum phase method and the like.

When the period of the audio signal is less than twice of the receiving delay between any two microphones (that is, a wavelength of the audio signal is less than twice of a product of the distance between the microphone and a cosine of the included angle between the connecting line of the microphones and the sound source direction), there may be multiple numerical solutions when the delay is calculated by using the cross power spectrum phase method, and the relative delay may be greatly deviated and may not be used for orientation. When the distances of some microphone pairs in the multiple microphone pairs in the microphone array are long and greater than twice of the wavelength, it may be ensured that the relative delay is less than a half of the period only when an incident direction of the audio signal is within a limited range, and beyond this range, there may be errors of relative delay calculation and angle calculation, and invalid values may be generated. When invalid directions may not be excluded in an effective manner, the invalid directions may be mixed into a final result to bring errors.

The microphone is unidirectional, and when it points to different angles, amplitude information may be used for orientation, which is favorable for excluding these invalid directions.

There is made such a hypothesis that sensitivity of the microphone at a certain frequency f in each direction theta may be represented with d(theta-thetak, f). d(alpha, f) represents that, in a direction forming an included angle with an orientation of the microphone is alpha, the sensitivity is maximum when alpha=0. The function d is also called a directivity function. When orientations of the microphone A and the microphone B are not the same direction but form an included angle beta and included angles between the incident direction of the signal of the sound source and the orientations of the two microphones are betaA and betaB respectively, directivity functions of the microphone A and the microphone B are d_A and d_B respectively. When the audio signal reaches the two microphones, a ratio of transmission attenuations HA and HB is consistent with a formula HA/HB=d_A(betaA)/d_B(betaB). When a numerical value of the directivity function d(alpha, f) significantly changes along with change of the angle alpha, an orientation of the audio signal relative to the microphone A and the microphone B may be obtained through the amplitude information. When the wavelength of the audio signal is shorter and the frequency is higher, the directivity of the microphone is more apparent and d(alpha, f) also changes more significantly along with change of the direction.

Taking a certain type of device of a hidden boundary microphone provided with six microphones which are as an example, a shape of the device is approximately a cylinder of which a diameter is about 8 cm, the microphones are arranged on a bottom surface of the product and close to the placement surface, and the same structural design is used for each microphone. The microphones ABCDEF are sorted counterclockwise in equal spacing. Under a shielding effect of a cylindrical housing, each microphone has apparent directivity, and because each microphone has the same structure, each microphone also has the same directivity function and an orientation is a connecting line from a circle center to the microphone.

In the embodiment of the disclosure, the sound source position may be calculated by use of the amplitude relationship of the audio signals received by the microphones and the relative receiving delay. Taking the audio interaction device provided with six microphones as an example, the six microphones may form 15 different microphone pairs. For each microphone pair, a receiving delay may be calculated based on the audio signals received by the two microphones and the first sound source position is determined based on the receiving delay. Weighting processing is further performed on the determined first sound source position based on each microphone pair. Herein, the weight value is related to at least one of the following information: an amplitude relationship of the audio signals received by the two microphones in the microphone pair, energy of the audio signal received by any microphone in the microphone pair, a distance between the two microphones in the microphone pair, or an attribute parameter of the audio signal received by any microphone in the microphone pair, where the attribute parameter includes at least one of: frequency, period or wavelength.

During the practical application, it may be preset that weight values of N microphone pairs are 1/N, N being a positive integer greater than 1. 1/N is further regulated based on at least one of abovementioned information, and after regulation, normalization processing is performed on the N weight values so as to obtain a sum 1 of the weight values of the N microphone pairs.

In an embodiment, when the distance between the two microphones in the microphone pair is greater than a half of the wavelength of the audio signal, the distance between the two microphones in the microphone pair is inversely correlated with the corresponding weight value, that is, when the distance between the two microphones in the microphone pair is larger, the corresponding weight value is smaller.

In an embodiment, under the condition that an incident direction of the audio signal may substantially be determined within an angle range, for each microphone pair, an acoustic path difference within the angle range is calculated. Herein, when the incident direction of the audio signal is in a region corresponding to the angle range, the distance between the two microphones in the microphone pair is multiplied by a cosine of a determined approximate direction of the audio signal in this region and a direction of the connecting line of the microphone pair. The product represents the acoustic path difference, i.e., a difference between paths through which the sound source of the audio signal reaches the two microphones in the microphone pair. It can be understood that the acoustic path difference is determined based on the distance between the two microphones in the microphone pair and the corresponding weight value is regulated according to a comparison result of the acoustic path difference and the wavelength.

As an example, when the acoustic path difference exceeds a ½ wavelength of the audio signal, a weight value of the corresponding microphone pair is reduced to 0.

As another example, the acoustic path difference is compared with a ⅜ wavelength of the audio signal, and when the acoustic path difference exceeds the ⅜ wavelength of the audio signal, a weight value of the corresponding microphone pair is reduced to ½ of the initial weight value 1/N.

As another example, under the condition that the incident direction of the sound source has no or is difficult to have a clear range, when the distance between the two microphones in the microphone pair exceeds the ½ wavelength of the audio signal, a weight value of the corresponding microphone pair is reduced to 0.

In an embodiment, when the energy of the audio signal received by a microphone is lower than energy of the audio signal received by another microphone, a weight value of the microphone pair with the microphone is lower than a weight value of the other pair microphone pair.

Herein, as an example, the energy of the audio signals received by the microphones is checked and sorted by size. A maximum value of the energy is determined. When the energy of the audio signal received by a certain microphone is lower than the energy maximum value by 6 dB or more, the weight value of the microphone pair is reduced to ½ of the initial weight value 1/N.

In an embodiment, when frequencies of the audio signals received by all the microphones in the multiple microphones are lower than a first preset threshold value such that the distance of the microphone pair formed by any two microphones of the multiple microphones is less than a half of a wavelength of the audio signal and a difference of the energy of the audio signals received by the two microphones in the microphone pair corresponding to the maximum distance is less than a first numerical value, the weight values of all the microphone pairs are equal.

In an embodiment, when the frequencies of the audio signals received by all the microphones of the multiple microphones are greater than a first preset threshold value and less than a second preset threshold value, such that the distance of the microphone pair formed by any two microphones of the multiple microphones is less than a half of the wavelength of the audio signal and the difference of the energy of the audio signals received by the two microphones in the microphone pair corresponding to the maximum distance is greater than the first numerical value and less than a second numerical value, the weight values of the microphone pairs formed by any two microphones of the multiple microphones are different, but differences between the weight values are within a preset threshold value range. It can be understood that, although the weight values are different, the differences are small and the weight values are close.

As an example, when a distance of a certain microphone pair is greater than a half of the wavelength of the audio signal, it is very likely that a relative delay of the microphone pair is greater than a half of the period of the audio signal, and the risk that the calculation result is invalid is also high. On such a basis, a first sound source position corresponding to the microphone pair corresponds to a small weight value. As another example, when energy of the audio signal received by a certain microphone is lower than energy of the audio signal received by another microphone, a signal to noise ratio of the audio signal received by the microphone is also low, and the first sound source position corresponding to the microphone pair including the microphone is greatly affected by the noise more. On such a basis, a first sound source position corresponding to the microphone pair corresponds to a small weight value. For reducing influence of environmental reflection and a calculation error, the amplitude estimation manner may also be used to exclude outliers. As another example, when a distance between the two microphones in the microphone pair is less than a half of a wavelength of the received audio signal or energy of the audio signal received by each microphone is close (for example, the differences between the received energy are within the preset threshold value range), the weight values corresponding to the first sound source positions determined for each microphone pair are the same or close.

Specifically, taking the number of the microphones being six as an example, namely, the microphone A, the microphone B, the microphone C, the microphone D, the microphone E and the microphone F are included. There is made such a hypothesis that the audio signal is incident from a 15-degree direction and orientations of the microphones ABCDEF are 0, 60, 120, 180, 240 and 300 degrees respectively. The direction of the audio signal is closest to the orientation of the microphone A. Herein, the microphone may refer to an omnidirectional microphone, the microphone and a structure around it (including the orientation of the microphone) form a microphone array element, and the microphone array element is unidirectional.

When the frequency of the audio signal is high, for example, 3,000 Hz, and a wavelength of the signal is 11.3 cm, it may be known, in combination with a diameter of a bottom surface of the device and arrangement information of the microphones, that the wavelength of the audio signal is less than twice of the distances of the microphone pairs AD, BE and CF and greater than twice of the distances of other microphone pairs in all the microphone pairs. The energy of the audio signals received by the six microphones may be compared to determine the microphone closest to the orientation of the microphone. For example, the energy of the audio signals received by the microphones is sorted, it is obtained that the energy of the microphone A is the largest, the energy of the microphone B is the second largest and the energy of the microphone F is at the third place. It can be determined that an incident angle of the audio signal is closest to the orientation of the microphone A, then the microphone B and then the microphone F. In such case, a sound source corresponding to the audio signal may substantially be positioned based on the microphone A and the microphone B, or the microphone A, the microphone B and the microphone F. In all the microphone pairs, a receiving relay of the microphone pair AD may be greater than ½ of the period of the signal, a calculated delay value is non-unique and may not be used for orientation, and the weight thereof is set to be 0. Such a risk may be avoided for other microphone pairs. Herein, for the three microphone pairs AB, AF and FB, the receiving delays are smallest, the energy of the received audio signals is strong and the signal to noise ratios are high. The sound source positions calculated for the three microphone pairs based on the receiving delays correspond to high weight values, while the weight values corresponding to the sound source positions calculated for other microphone pairs based on the receiving delays are less than the high weight values. In addition, when a direction calculated for a certain microphone pair is deviated from an approximate region determined based on the microphone A and the microphone B or based on the microphone A, the microphone B and the microphone F, the microphone pair may be subjected to abnormal reflection interference or noise interference and should be excluded, and the corresponding weight value thereof is set to be 0. Similarly, when a frequency of the audio signal is higher, more microphone pairs may also be excluded.

When a frequency of the audio signal is low, for example, 1,500 Hz, and the wavelength of the audio signal is 22.6 cm, the distances of all the microphone pairs are less than a half of the wavelength, and the sound source positions calculated for all the microphone pairs may be used for weighted calculation of the final sound source position. The directivity of each microphone is apparent at this frequency. In comparison of the energy of the microphone array elements and the microphone pairs, it can be seen that the energy of the microphone D is lowest and the difference of the energy of the microphone pair AD is greatest. Then, during weighting processing over the sound source positions calculated for all the microphone pairs, a weight value of the microphone pair AD is smallest, a weight value of another microphone pair including the microphone D is the second smallest, while the weight values of the microphone pair AB, microphone pair AF and microphone pair BF corresponding to strongest energy and small energy differences are largest.

When the frequency of the audio signal is lower, for example, 500 Hz, and the wavelength of the audio signal is 67.8 cm, the distances of all the microphone pairs are less than a half of the wavelength, the directivity of the microphone array elements is not so apparent at this frequency. Even the microphone pair has the largest energy difference, the energy difference also does not exceed 3 dB, and in such case, the weight of the sound source direction calculated for each microphone pair is close. When the frequency of the audio signal is lower, for example, 200 Hz, the directivity of the microphone array element is quite low, the weight of the sound source direction calculated for each microphone pair is equal.

It is to be noted that, the abovementioned manner is a sound source positioning manner for the boundary microphones with a shielding effect inside the device, and the embodiment of the disclosure is intended to avoid the error problem caused by the fact that the receiving delay of the microphone pair is greater than a half of the period as much as possible by use of the shielding effect.

In the embodiment of the disclosure, sound sources in multiple different directions may be calculated successively. After it is determined that the sound source in a specific direction is required to be enhanced, a sound source direction and a certain angle range on the left and the right may be set as a protection region, the other directions are set as restricted regions, enhancement processing is performed on an audio signal from the protection region while audio signals from the restricted regions are weakened, so as to achieve the effect of improving the intelligibility of the audio signal and the audio quality. An enhancement method for the audio signal may include a super-directivity array filter, a minimum variance distortion-free response array filter, a blind source separation method and the like.

In an embodiment, an audio instruction identification program is further stored in the memory. The processor executes the audio instruction recognition program to implement identification of audio data obtained based on audio signal conversion and obtaining of an audio instruction in the audio data.

Specifically, the user may control the audio interaction device in a voice manner, for example, controlling the audio interaction device to play a music file, pause to play the music file and switch to play a "previous" or "next" music file and the like. On such a basis, a microphone related component, for example, an analog-to-digital conversion module, is further arranged in the audio interaction device, and configured to perform analog-to-digital conversion on the audio signal to obtain the audio data. Then, the processor executes the audio instruction identification program to identify the audio data and obtain the audio instruction in the audio data.

In an embodiment, the audio interaction device may further include a communication component, and the communication component supports communication in a wired network or wireless network between the audio interaction device and another device. The audio interaction device may access a wireless network based on a communication standard, and the communication standard includes at least one of: Wireless Fidelity (WiFi) or a mobile communication standard (such as 2nd-Generation (2G), 3rd-Generation (3G), 4th-Generation (4G) and 5th-Generation (5G)). In an exemplary embodiment, the communication component receives a broadcast signal or broadcasts related information from an external broadcast management system through a broadcast channel. In an exemplary embodiment, the communication component further includes a Near Field Communication (NFC) module to promote short-range communication. For example, the NFC module may be implemented based on a Radio Frequency Identification (RFID) technology, an Infrared Data Association (IrDA) technology, an Ultra-WideBand (UWB) technology, a Bluetooth (BT) technology and other technologies.

In an embodiment, the audio interaction device may further include a power component configured to provide power for each component in the audio interaction device. The power component may include a power management system, one or more power supplies, and other components associated with generation, management and distribution of power for the audio interaction device.

In the embodiment, the processor is configured to control overall operations of the audio interaction device, such as audio output control, audio input control, volume regulation and audio output content control. The processor may include at least one module for interaction with other components. For example, the processor may include a microphone module for processing interaction with the microphone.

In the embodiment, the memory may be implemented by a volatile or nonvolatile memory of any type or a combination thereof. Herein, the nonvolatile memory may be a Read Only Memory (ROM), a Programmable Read-Only Memory (PROM), an Erasable Programmable Read-Only Memory (EPROM), an Electrically Erasable Programmable Read-Only Memory (EEPROM), a Ferromagnetic Random Access Memory (FRAM), a flash memory, a magnetic surface memory, a compact disc or a Compact Disc Read-Only Memory (CD-ROM). The magnetic surface memory may be a disk memory or a tape memory. The volatile memory may be a Random Access Memory (RAM), and is used as an external high-speed cache. It is exemplarily but unlimitedly described that RAMs in various forms may be adopted, such as a Static Random Access Memory (SRAM), a Synchronous Static Random Access Memory (SSRAM), a Dynamic Random Access Memory (DRAM), a Synchronous Dynamic Random Access Memory (SDRAM), a Double Data Rate Synchronous Dynamic Random Access Memory (DDRSDRAM), an Enhanced Synchronous Dynamic Random Access Memory (ESDRAM), a SyncLink Dynamic Random Access Memory (SLDRAM) and a Direct Rambus Random Access Memory (DRRAM). The memory described in the embodiment of the disclosure is intended to include, but not limited to, memories of these and any other proper types.

Figure 6:
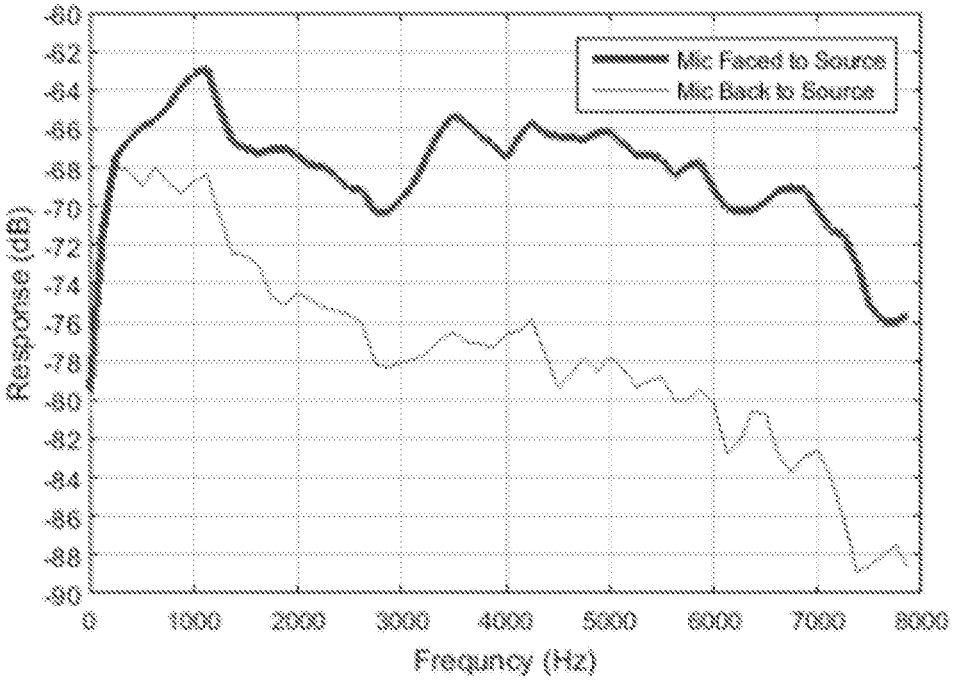
FIG. 6 is a schematic diagram of sensitivity of microphones facing a sound source, and microphones back on to the sound source, of an audio interaction device according to an embodiment of the disclosure.
Figure 7:
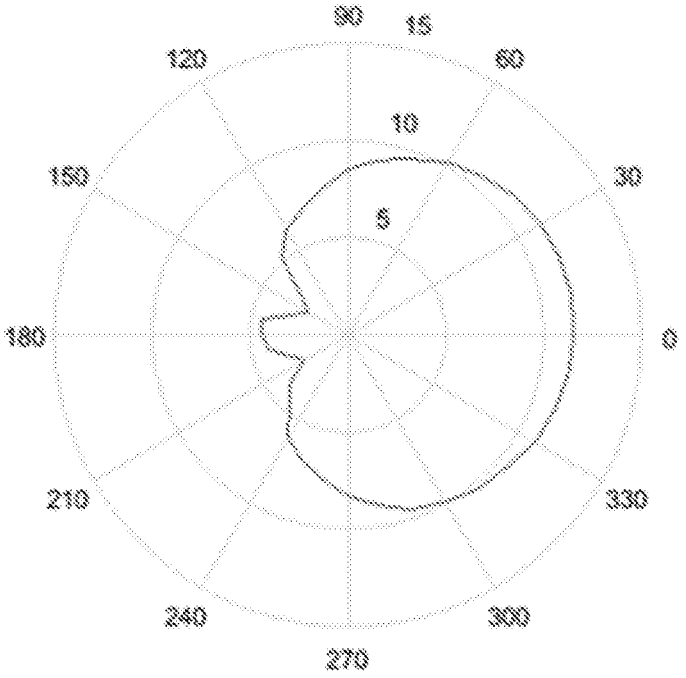
FIG. 7 is a schematic diagram of sensitivity of microphones of an audio interaction device in each direction according to an embodiment of the disclosure.

By using the technical solution in the embodiment of the disclosure, on one aspect, the microphones are arranged at the bottom of the audio interaction device close to the placement surface, so that the aesthetics of the overall appearance of the audio interaction device is improved, and noises produced by accidentally touching the microphones during operation are also avoided. On the other aspect, in the embodiment, the loudspeaker is arranged on the other side away from the microphones, namely laid out at the top of the audio interaction device, so that an audio output effect of the audio interaction device is improved. FIG. 6 is a schematic diagram of sensitivity of microphones facing a sound source and microphones back on to the sound source, of an audio interaction device according to an embodiment of the disclosure. As illustrated in FIG. 6, there is an amplitude difference of greater than 5 dB at more than 1,500 Hz and there is an amplitude difference of greater than 8 dB at more than 3,000 Hz. FIG. 7 is a schematic diagram of sensitivity of microphones of an audio interaction device in each direction according to an embodiment of the disclosure. As illustrated in FIG. 7, when the signal source is at 0 degree and 180 degrees, the sensitivity difference exceeds 5 dB.

An embodiment of the disclosure also provides a data processing method, which is applied in the abovementioned audio interaction device and used to process an audio signal received by the audio interaction device. The method includes the following operations.

At block 101, audio signals are obtained through multiple microphones.

At block 102, a first sound source position is determined using at least one microphone pair formed by any two microphones of the multiple microphones by delay estimation and/or amplitude estimation.

At block 103, weighting processing is performed on multiple determined first sound source positions to obtain a sound source position.

The data processing method of the embodiment is mainly used to perform sound source positioning processing on the audio signals received by the multiple microphones.

As an implementation mode, the operation that the first sound source position is determined using the at least one microphone pair formed by any two microphones of the multiple microphones by the delay estimation includes the following actions. A first audio signal received by a first microphone is obtained, and a second audio signal received by a second microphone is obtained; a receiving delay is determined based on the first audio signal and the second audio signal; a difference of distances between a sound source and each of the first microphone and the second microphone is determined based on the receiving delay; and the first sound source position is determined based on the difference of the distances and a distance between the first microphone and the second microphone. A specific implementation process may refer to description in the abovementioned embodiment and will not be described herein.

In an embodiment, there is made such a hypothesis that sensitivity of the microphone at a certain frequency f in each direction theta may be represented by d(theta-thetak, f). d(alpha, f) represents that, in a direction forming an included angle with an orientation of the microphone is alpha, the sensitivity is maximum when alpha=0. The function d is also called a directivity function. When orientations of the microphone A and the microphone B are not the same direction but form an included angle beta and included angles between the incident direction of the signal of the sound source and the orientations of the two microphones are betaA and betaB respectively, directivity functions of the microphone A and the microphone B are d_A and d_B respectively. When the audio signal reaches the two microphones, a ratio of transmission attenuations HA to HB is consistent with a formula HA/HB=d_A(betaA)/d_B(betaB). When a numerical value of the directivity function d(alpha, f) significantly changes along with change of the angle alpha, an orientation of the audio signal relative to the microphone A and the microphone B may be obtained through the amplitude information. When a wavelength of the audio signal is smaller and the frequency is higher, the directivity of the microphone is more apparent and d(alpha, f) also changes more significantly along with change of the direction.

In an embodiment, the operation that the weighting processing is performed on the multiple determined first sound source positions to obtain the sound source position may include the following the following actions. A weight value of the first sound source position corresponding to the microphone pair is determined based on at least one of the following information, and weighting processing is performed based on the weight value and the corresponding first sound source position to obtain a sound source position.

The information may include: an amplitude relationship of the audio signals received by the two microphones in the microphone pair, energy of the audio signal received by any microphone in the microphone pair, a distance between the two microphones in the microphone pair, or an attribute parameter of the audio signal received by any microphone in the microphone pair, where the attribute parameter includes at least one of: frequency, period or wavelength.

During the practical application, it may be preset that weight values of N microphone pairs are 1/N, where N is a positive integer greater than 1. 1/N is further regulated based on at least one of abovementioned information, and after regulation, normalization processing is performed on the N weight values so as to obtain a sum 1 of the weight values of the N microphone pairs.

In an embodiment, when the distance between the two microphones in the microphone pair is greater than a half of the wavelength of the audio signal, the distance between the two microphones in the microphone pair is inversely correlated with the corresponding weight value. That is, when the distance between the two microphones in the microphone pair is greater, the corresponding weight value is smaller. When a region where the incident direction of the signal is located is known, the distance between the two microphones in the microphone pair is multiplied by a cosine of a certain incident direction in this region and a direction of the connecting line of the microphone pair, and when an absolute value of a product is greater than a half of the wavelength of the audio signal, the weight value of the microphone pair is reduced to 0.

In an embodiment, under the condition that the incident direction of the audio signal may substantially be determined within an angle range, for each microphone pair, an acoustic path difference within the angle range is calculated. Herein, when the incident direction of the audio signal is in a region corresponding to the angle range, the distance between the two microphones in the microphone pair is multiplied by a cosine of a determined approximate direction of the audio signal in this region and a direction of the connecting line of the microphone pair, and a product represents the acoustic path difference, i.e., a difference between paths through which the sound source of the audio signal reaches the two microphones in the microphone pair. It can be understood that the acoustic path difference is determined based on the distance between the two microphones in the microphone pair and the corresponding weight value is regulated according to a comparison result of the acoustic path difference and the wavelength.

As an example, when the acoustic path difference exceeds a ½ wavelength of the audio signal, a weight of the corresponding microphone pair is reduced to 0.

As another example, the acoustic path difference is compared with a ⅜ wavelength of the audio signal. When the acoustic path difference exceeds the ⅜ wavelength of the audio signal, the weight value of the corresponding microphone pair is reduced to ½ of the initial weight value 1/N.

As another example, under the condition that the incident direction of the sound source has no or is difficult to have a clear range, when the distance between the two microphones in the microphone pair exceeds the ½ wavelength of the audio signal, A weight value of the corresponding microphone pair is reduced to 0.

In an embodiment, when the energy of the audio signal received by a microphone is lower than energy of the audio signal received by another microphone, a weight value of the microphone pair with the microphone is lower than a weight value of the other pair microphone pair.

Herein, as an example, the energy of the audio signals received by the microphones is checked and sorted by size. A maximum value of the energy is determined. When the energy of the audio signal received by a certain microphone is lower than the energy maximum value by 6 dB or more, the weight value of the microphone pair is reduced to ½ of the initial weight value 1/N.

In an embodiment, when frequencies of the audio signals received by all the microphones in the multiple microphones are lower than a first preset threshold value such that the distance of the microphone pair formed by any two microphones of the multiple microphones is less than a half of a wavelength of the audio signal and a difference of the energy of the audio signals received by the two microphones in the microphone pair corresponding to the maximum distance is less than a first numerical value, the weight values of all the microphone pairs are equal.

In an embodiment, when the frequencies of the audio signals received by all the microphones of the multiple microphones are greater than the first preset threshold value and less than a second preset threshold value such that the distance of the microphone pair formed by any two microphones of the multiple microphones is less than a half of the wavelength of the audio signal and the difference of the energy of the audio signals received by the two microphones in the microphone pair corresponding to the maximum distance is greater than the first numerical value and less than a second numerical value, the weight values of the microphone pairs formed by any two microphones of the multiple microphones are different, but differences between the weight values are within a preset threshold value range. It can be understood that, although the weight values are different, the differences are small and the weight values are close.

As an example, when a distance of a certain microphone pair is greater than a half of the wavelength of the audio signal, it is very likely that a relative delay of the microphone pair is greater than a half of the period of the audio signal, and the risk that the calculation result is invalid is also high. On such a basis, a first sound source position corresponding to the microphone pair corresponds to a small weight value. As another example, when the energy of the audio signal received by a certain microphone is lower than energy of the audio signal received by another microphone, a signal to noise ratio of the audio signal received by the microphone is also low, and the first sound source position corresponding to the microphone pair including the microphone is greatly affected by the noise more. On such a basis, a first sound source position corresponding to the microphone pair corresponds to a small weight value. For reducing influence of environmental reflection and a calculation error, the amplitude estimation manner may also be used to exclude outliers. As another example, when the distance between the two microphones in the microphone pair is less than a half of a wavelength of the received audio signal or energy of the audio signal received by each microphone is close (for example, the differences between the received energy are within the preset threshold value range), the weight values corresponding to the first sound source positions determined for each microphone pair are the same or close.

An embodiment of the disclosure also provides a computer-readable storage medium, in which a computer program is stored, the computer program being executed by a processor to implement the operations of the data processing method in the embodiments of the disclosure.

In some embodiments provided in the application, it is to be understood that the device embodiment described above is only schematic, and for example, division of the units is only logic function division, and other division manners may be adopted during practical implementation. For example, multiple units or components may be combined or integrated into another system, or some characteristics may be neglected or not executed. In addition, coupling or direct coupling or communication connection between each displayed or discussed component may be indirect coupling or communication connection, implemented through some interfaces, of the device or the units, and may be electrical and mechanical or in other forms.

The units described as separate parts may or may not be physically separated, and parts displayed as units may or may not be physical units, and namely may be located in the same place, or may also be distributed to multiple network units. Part of all of the units may be selected according to a practical requirement to achieve the purposes of the solutions of the embodiments.

Those skilled in the art should know that all or part of the operations of the method embodiment may be implemented by related hardware instructed through a program, the program may be stored in a computer-readable storage medium, and the program is executed to execute the operations of the method embodiment. The storage medium includes: various media capable of storing program codes such as a mobile storage device, a ROM, a RAM, a magnetic disk or a compact disc.

Or, when being implemented in form of software functional module and sold or used as an independent product, the integrated unit of the disclosure may also be stored in a computer-readable storage medium. Based on such an understanding, the technical solutions of the embodiments of the disclosure substantially or parts making contributions to the related art may be embodied in form of a software product, and the computer software product is stored in a storage medium, including a plurality of instructions configured to enable a computer device (which may be a personal computer, a server, a network device or the like) to execute all or part of the method in each embodiment of the disclosure. The storage medium includes: various media capable of storing program codes such as a mobile hard disk, a ROM, a RAM, a magnetic disk or a compact disc.

In addition, each functional unit in each embodiment of the disclosure may be integrated into a processing unit, each unit may also serve as an independent unit and two or more than two units may also be integrated into a unit. The integrated unit may be implemented in a hardware form and may also be implemented in form of hardware and software functional unit.

The above is only the specific implementation mode of the disclosure and not intended to limit the scope of protection of the disclosure. Any variations or replacements apparent to those skilled in the art within the technical scope disclosed by the disclosure shall fall within the scope of protection of the disclosure. Therefore, the scope of protection of the disclosure shall be subject to the scope of protection of the claims.

The invention claimed is:

1. An audio interaction device, comprising: a shell, at least one loudspeaker, a plurality of microphones located in a plurality of accommodation portions of the shell, at least one processor and a memory configured to store a computer program capable of running on the processor, wherein the processor is configured to run the computer program to execute the following operations: identifying audio signals obtained by the plurality of microphones and processing the audio signals;

wherein the plurality of microphones are boundary microphones and arranged at positions close to a first surface of the shell of the audio interaction device, and the first surface is attached or close to a placement surface on which the audio interaction device is placed; and wherein a distance between a first plane where the at least one loudspeaker is located and a second plane where the plurality of microphones are located is greater than a threshold value, wherein the threshold value is determined at least by a maximum volume of the at least one loudspeaker and upper limits of measurable sound pressure levels of the plurality of microphones.

2. The device of claim 1, wherein the shell is provided with a plurality of first acoustic transmission holes, wherein each of the plurality of first acoustic transmission holes corresponds to each microphone of the plurality of microphones; and the plurality of first acoustic transmission holes are located at a junction of the first surface and a lateral surface of the audio interaction device.

3. The device of claim 2, wherein the shell provided with the plurality of first acoustic transmission holes is formed with the plurality of accommodation portions, each accommodation portion having at least one reflective surface, and the microphones are located in the plurality of accommodation portions.

4. The device of claim 3, wherein each microphone of the plurality of microphones corresponds to each portion of the plurality of accommodation portions, and the plurality of accommodation portions have the same structure.

5. The device of claim 2, wherein the plurality of first acoustic transmission holes form centrosymmetric openings on the shell.

6. The device of claim 1, wherein the number of the plurality of microphones is associated with at least one attribute parameter of an audio signal to be received.

7. The device of claim 1, wherein any two adjacent microphones of the plurality of microphones have equal included angles formed by the any two adjacent microphones and a central axis of the audio interaction device.

8. The device of claim 1, wherein the at least one loudspeaker is arranged at a position close to a second surface of the shell of the audio interaction device, wherein the second surface is away from the first surface.

9. The device of claim 8, wherein the second surface of the shell is provided with at least one second acoustic transmission hole, each hole corresponding to each loudspeaker of the at least one loudspeaker.

10. The device of claim 1, wherein the processor further executes the following operations: determining a first sound source position using at least one microphone pair formed by any two microphones of the plurality of microphones by at least one of: delay estimation or amplitude estimation; and performing weighting processing on the plurality of determined first sound source positions to obtain a sound source position.

11. The device of claim 10, wherein performing the weighting processing on the plurality of determined first sound source positions to obtain the sound source position comprises:

determining a weight value of the first sound source position corresponding to the microphone pair based on at least one of the following information:

an amplitude relationship of the audio signals received by the two microphones in the microphone pair, energy of the audio signal received by any microphone of the microphone pair, a distance between the two microphones in the microphone pair, or an attribute parameter of the audio signal received by any microphone of the microphone pair, wherein the attribute parameter comprises at least one of:

frequency, period or wavelength; and performing weighting processing based on the weight value and the corresponding first sound source position to obtain a sound source position.

12. A data processing method, applied in an audio interaction device, wherein the device comprises: a shell, at least one loudspeaker, and a plurality of microphones located in a plurality of accommodation portions of the shell; wherein the plurality of microphones are boundary microphones and arranged at positions close to a first surface of the shell of the audio interaction device, and the first surface is attached or close to a placement surface on which the audio interaction device is placed, and wherein a distance between a first plane where the at least one loudspeaker is located and a second plane where the plurality of microphones are located is greater than a threshold value, wherein the threshold value is determined at least by a maximum volume of the at least one loudspeaker and upper limits of measurable sound pressure levels of the plurality of microphones;

wherein the method comprises:

obtaining audio signals through the plurality of microphones;

determining a first sound source position using at least one microphone pair formed by any two microphones of the plurality of microphones by at least one of: delay estimation or amplitude estimation; and performing weighting processing on a plurality of determined first sound source positions to obtain a sound source position.

13. The method of claim 12, wherein performing weighting processing on the plurality of determined first sound source positions to obtain the sound source position comprises:

determining a weight value of the first sound source position corresponding to the microphone pair based on at least one of the following information:

an amplitude relationship of the audio signals received by the two microphones in the microphone pair, energy of the audio signal received by any microphone of the microphone pair, a distance between the two microphones in the microphone pair, or an attribute parameter of the audio signal received by any microphone of the microphone pair, wherein the attribute parameter comprises at least one of:

frequency, period or wavelength; and performing weighting processing based on the weight value and the corresponding first sound source position to obtain the sound source position.

14. The method of claim 12, wherein the shell is provided with a plurality of first acoustic transmission holes, wherein each of the plurality of first acoustic transmission holes corresponds to each microphone of the plurality of microphones; and the plurality of first acoustic transmission holes are located at a junction of the first surface and a lateral surface of the audio interaction device.

15. The method of claim 14, wherein the shell provided with the plurality of first acoustic transmission holes is formed with the plurality of accommodation portions, each accommodation portion having at least one reflective surface, and the microphones are located in the accommodation portions.

16. The method of claim 15, wherein each microphone of the plurality of microphones corresponds to each portion of the plurality of an accommodation portions, and the plurality of accommodation portions have the same structure.

17. The method of claim 14, wherein the plurality of first acoustic transmission holes form centrosymmetric openings on the shell.

18. The method of claim 12, wherein the number of the plurality of microphones is associated with at least one attribute parameter of an audio signal to be received.

19. The method of claim 12, wherein any two adjacent microphones of the plurality of microphones have equal included angles formed by the any two adjacent microphones and a central axis of the audio interaction device.

20. A non-transitory computer-readable storage medium, in which a computer program is stored, wherein the computer program is configured to implement operations of the data processing method of claim 12.

* * * * *